US005542178A

United States Patent [19]

Harkleroad

[11] Patent Number: 5,542,178

[45] Date of Patent: Aug. 6, 1996

[54] RAZOR FOR SHAVING CURVED AREAS OF THE BODY

[76] Inventor: Zeke S. Harkleroad, P.O. Box 127, Barnhart, Tex. 76930

[21] Appl. No.: 549,222

[22] Filed: Oct. 27, 1995

[51] Int. Cl.[6] ..... B26B 21/40

[52] U.S. Cl. ..... 30/34.1; 30/47

[58] Field of Search ..... 30/32, 34.05, 34.1, 30/47, 49, 50

[56] References Cited

U.S. PATENT DOCUMENTS

| | | | |
|---|---|---|---|
| D. 221,717 | 8/1971 | Poisson | D95/3 |
| D. 310,889 | 9/1990 | Concialdi | D28/45 |
| 2,501,987 | 3/1950 | Brown . | |
| 3,724,070 | 4/1973 | Dorion, Jr. | 30/47 |
| 4,208,791 | 6/1980 | Van Cleve | 30/49 |
| 4,498,236 | 2/1985 | McIntyre et al. | 30/34.1 |
| 4,901,437 | 2/1990 | Iten | 30/50 |
| 4,961,262 | 10/1990 | Lawrence | 30/32 |
| 5,022,153 | 6/1991 | Baron | 30/34.1 |
| 5,307,564 | 5/1994 | Schoenberg | 30/50 |

FOREIGN PATENT DOCUMENTS

| | | | |
|---|---|---|---|
| 517806 | 5/1921 | France . | |
| 2641489 | 7/1990 | France | 30/34.1 |
| 84/00319 | 2/1984 | WIPO | 30/34.1 |
| 92/06826 | 4/1992 | WIPO . | |

*Primary Examiner*—Hwei-Siu Payer
*Attorney, Agent, or Firm*—Richard C. Litman

[57] ABSTRACT

An additional arched razor blade attached to a convention razor for shaving hard to reach areas. The razor head includes attachment means which provide for the new blade to be of variable curvature. In a first embodiment, fixed seats hold the ends of the new blades; thus blades of different length are inserted in the seats to adjust the blade curvature. In a second embodiment, moveable seats provide for altering the distance between the seats and thus the adjustment of the blade curvature.

8 Claims, 1 Drawing Sheet

RAZOR FOR SHAVING CURVED AREAS OF THE BODY

BACKGROUND OF THE INVENTION

1. Field of the Invention

The present invention relates to razors for cosmetic removal of hair from the body.

2. Description of the Prior Art

Razors of various designs have been developed for cosmetic removal of body hair. Many razors using fixed blades have been developed to simplify and safeguard the shaving process. Razors using blades of non-standard shape and including multiple blades used for different purposes have thus been developed.

There are many prior art razors which may be modified by the teachings of the present invention. Typical of a showing of disposable razors for shaving the face with a single shaving surface composed of flat blades is U.S. Pat. No. 3,724,070 issued Apr. 20, 1973, to F. W. Dorion, Jr. Showing a less common design, but still using a similar principle for shaving, is seen in U.S. Pat. No. 2,501,987 issued Mar. 28, 1950, to A. D. Brown. These patents disclose razors with a single shaving surface designed for general facial shaving.

Due to the complex shape of the human body, razors have been developed with various shapes for shaving different areas. U.S. Pat. No. 4,961,262, issued Oct. 9, 1990, shows a razor having dual arcuate blades specifically designed for trimming or shaving around the eyebrow. This patent does not show a flexible blade for shaving specific areas nor does it include a blade for general purpose shaving as does the present invention. Also showing a razor having a curved blade is French Patent No. 517.806, issued Dec. 22, 1920. The French Patent shows a razor having a single blade with a curved edge which is distinct from the arched flexible blade described herein.

Curved blades have been used particularly in razors designed for improved shaving of legs and armpits. International Application Publication No. WO 92/06826 shows a double curved razor wherein the blade is both curved and arched. The single blade, which is contained in a fixed position, is designed to be used for all shaving operations accomplished by the razor. Another similar design is seen in U.S. Pat. No. 4,208,791, issued Jun. 24, 1980, to B. J. Van Cleve, which shows a razor having both a convex blade and a concave blade in fixed, relatively similar orientations. Also showing a fixed arched blade for shaving curved body areas like the armpit is U.S. Pat. No. 4,901,437, issued Feb. 20, 1990, to C. A. Iten. This patent discloses a second blade having a relatively large radius of curvature which is held in a fixed arched position opposite a typical flat dual blade shaving surface. The auxiliary blade shown in Iten remains in a fixed position.

Also of some interest are design patents showing similar razors such as U.S. Pat. No. Des. 221,717 issued Aug. 31, 1971, to N. D. Poisson and U.S. Pat. No. Des. 310,889 issued Sep. 25, 1990, to T. Concialdi. Neither of these designs show an auxiliary blade like that presently disclosed.

None of the above inventions and patents, taken either singly or in combination, is seen to describe the instant invention as claimed.

SUMMARY OF THE INVENTION

The present invention provides a razor which improves a shavers ability to remove hair from tightly curved areas of the face. Using a razor having only a traditional flat, straight razor blades, it is difficult to shave certain curved features of the face, such as the philtrum, the middle vertical groove on the upper lip below the nose. Although some razors have included curved blades for shaving curved areas of the body, the blades provided have not been sufficiently curved for successful use on body features such as the philtrum. A razor including a severely arched blade is provided on the razor of the present invention to allow improved shaving of tightly curved facial features. The blade is highly versatile as it may have a curvature selected for a user's particular needs, may be flexible to adjust to the surface shaved, and may have a user-adjustable curvature.

Although the arched blade disclosed may be permanently secured on a razor, particularly if the entire razor is disposable, it is contemplated to provide the particular curvature needed by a particular user. In the case of the disposable razor multiple models would be provided having different radii of curvature. However, razors of the present invention using replaceable blades will accommodate multiple blades of different or adjustable curvature. The handle of the instant razor includes a receptacle for receiving a curved blade cartridge. The curved blade cartridge includes a flexible blade retained at its ends to form an arch having a radius of curvature at least as small as the length of the blade. Different curvatures are provided with different cartridges. Safe storage of a razor including this auxiliary blade may be accomplished by including a pivoting mechanism which rotates the blade against the surface of the razor handle.

An alternative blade arrangement providing for safe storage of the auxiliary blade is a cartridge in which at least one end of the blade is selectively adjustable in relation to the other. In this arrangement the curvature of the blade may be adjusted by altering the distance between the ends of the blade. To store the blade the ends may separated so that the blade may lie flat against the cartridge.

Accordingly, it is a principal object of the invention to provide a razor suitable for shaving tightly curved facial features.

It is another object of the invention to provide a razor where the curvature of a blade may be selected for the particular shaving need.

It is a further object of the invention to provide a arched blade on a razor which is stowable in a safe position on the razor.

Still another object of the invention is to provide an arched blade on a razor which has a selectively adjustable curvature.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
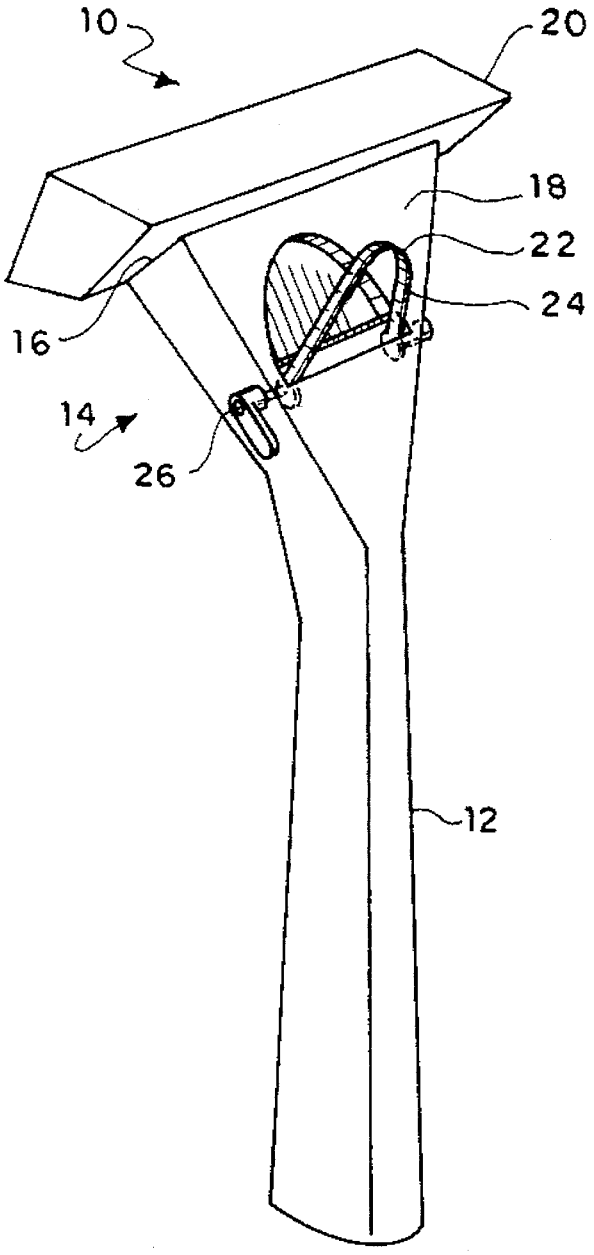
FIG. 1 is a perspective view of a razor including an auxiliary blade according to the present invention.

An improved razor 10 for shaving highly curved surfaces of the body is shown in FIG. 1. Razor 10 as shown includes a handle 12 having a head portion 14. Head portion 14 includes a face 16 and a back 18. A traditional primary blade assembly 20 is connected to face 16. Protruding from back 18 opposite primary blade assembly 20 are one or more auxiliary arched blades 22 which compliment the primary blade assembly 20. Blade 22 is configured to be used alternately with primary blade assembly 20 when shaving tightly curved surfaces of the face. Blade 22 is thus disposed in position on handle 12 opposite primary blade assembly 20.

Figure 2:
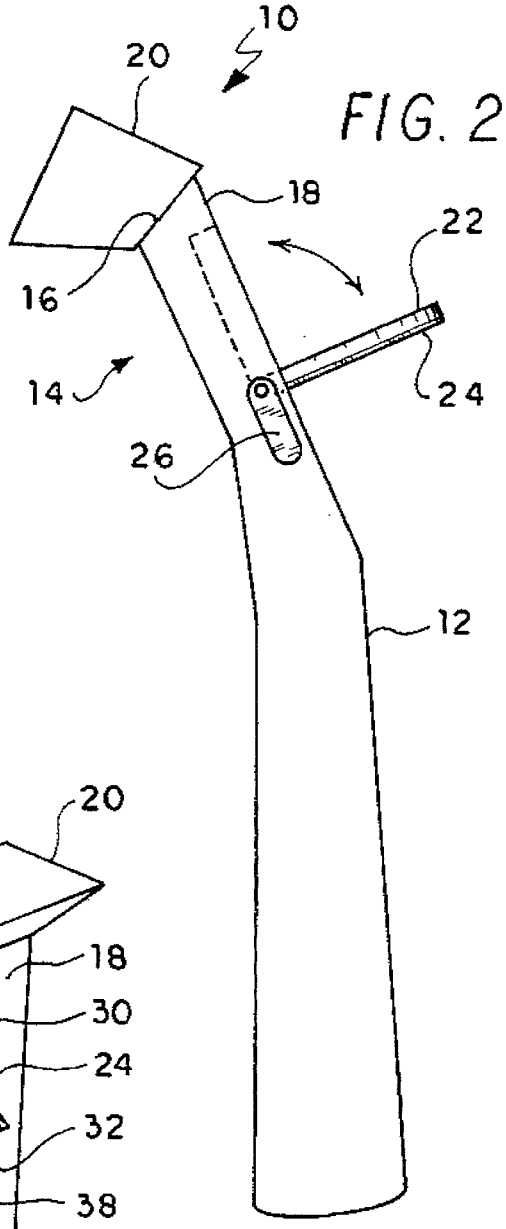
FIG. 2 is a side view of the razor of FIG. 1.

Blade 22 is bent into an arch having a small radius of curvature with the ends of blade 22 secured to handle 12. The radius of curvature of blade 22 is as small or smaller than the length of blade 22. Blade 22 has a sharp shaving edge 24 curved by the arch of blade 22. The amount of curvature induced by the arch is selected to match the curvature of areas of the body, such as the philtrum, that are difficult to shave. Blade 22 may be permanently attached to razor 10, especially if the entire razor is disposable. However, if the razor is not disposable, then it is preferred that blade 22 be replaceable. Alternate blades may be provided having various preformed degrees of curvature. Thus, a user may select a blade of desired curvature to meet his shaving needs. Blade 22 may be included on a cartridge attachable to razor 10 in a manner similar the attachment of primary blade assembly 20 to handle 12. Blade 22 may be attached to a pivot mechanism 26 providing means for safely storing blade 22 against handle 12. Pivot mechanism 26 connects the ends of blade 22 to handle 12 in a manner which allows blade 22 to be rotated to a safe stowed position against handle 12 when not in use as is shown in FIG. 2.

Figure 3:
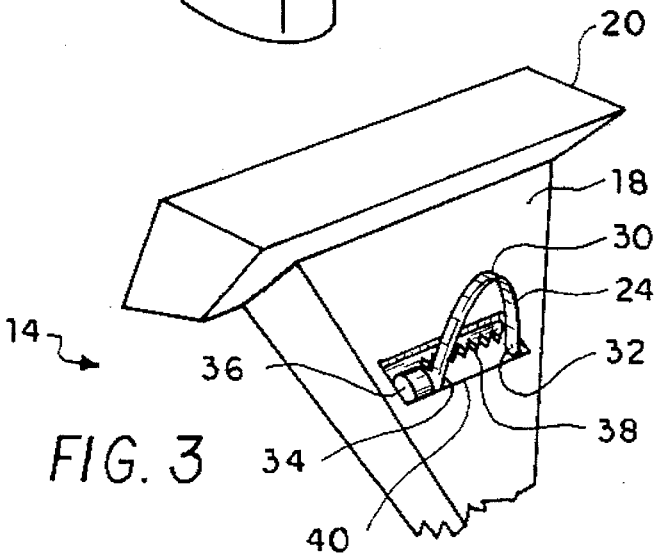
FIG. 3 is a rear view of a razor including an alternate embodiment of the auxiliary blade.

A second embodiment of the present invention is shown in FIG. 3. The auxiliary blade 30 of FIG. 3 is flexible and resilient. The protruding flexible blade conforms in part to the shape of the surface being shaved. In its natural or relaxed state, blade 30 is a flat substantially rectangular blade with a sharp edge 24. To provide the useful curved shape of blade 30 the ends 32 and 34 are forced together thus bending blade 30 into an arch. Ends 32 and 34 are then fixed in seats on razor be. Alternate blades of varying lengths may be selected so that when seated on razor 10 alternate curvatures will be produced.

Alternatively, means for adjusting the curvature of blade 22 may be provided as shown in FIG. 3. Blade 30 is shown fixed at end 32 and adjustable at end 34. A channel 40 is formed on handle 12. End 32 of blade 22 is secured in a fixed seat at one end of channel 40. Retained in channel 40 is slide 36 which is slidable along channel 40. Connected to slide 36 is end 34 of blade 22. Slide 36 is used to push end 34 towards end 32 thus bending blade 30 into its arched form. A row of detent notches 38 is provided in a side of channel 40. Slide 36 engages detent notches 38 allowing slide 36 to be selectively locked in positioned along channel 40. The position of slide 36 will determine the amount of curvature in blade 30.

It is to be understood that the present invention is not limited to the embodiments described above, but encompasses any and all embodiments within the scope of the following claims.

I claim:

1. A razor for shaving highly curved body surfaces, said razor comprising:

a handle including a head portion having a face and a back;

a primary blade assembly attached to the face of said handle;

a channel formed in the back of said handle;

a row of detent notches formed in said channel;

an adjustment slide retained in said channel, said adjustment slide being slidable within said channel and being selectively engageable with said row of detent notches for locking said adjustment slide in a selected location;

a flexible, resilient, substantially rectangular blade having, a sharp edge, a first end secured in fixed position in said channel, a second end secured to said adjustment slide;

whereby movement of said adjustment slide toward said first end of said blade causes said flexible blade to assume an arched position.

2. A razor for shaving highly curved body surfaces, said razor comprising:

a handle;

a primary blade assembly connected to said handle; and an auxiliary razor blade protruding from said handle opposite said primary blade assembly, said auxiliary blade having a sharp edge, a first end, and a second end, said auxiliary blade being arched such that said first end and said second end of said auxiliary blade are secured to said handle and said sharp edge of said auxiliary blade has a curvature;

whereby said curvature of said sharp edge is configured substantially to match a curvature of a selected body surface to be shaved.

3. The razor according to claim 2, wherein said curvature of said blade has a radius less than a length of said blade from said first end and said second end.

4. The razor according to claim 2 further including stowage means for safely storing said auxiliary blade on said handle when not in use.

5. The razor according to claim 4 wherein said stowage means includes a pivot mechanism for rotating said auxiliary blade from a deployed position protruding from said handle to a stowed position against said handle.

6. The razor according to claim 2, wherein said auxiliary blade is flexible and resilient.

7. The razor according to claim 6, further including adjustment means for adjusting the curvature of said auxiliary blade.

8. The razor according to claim 6, wherein said adjustment means includes:

a row of detent notches formed on said handle;

a fixed seat disposed on said handle, said fixed seat securing said first end of said auxiliary blade to said handle; and an adjustment slide connected to said second end of said auxiliary blade, said adjustment slide being slidably retained on said handle such that said slide is free to move relative to said fixed seat, said adjustment slide being selectively engageable with said detent notches for retaining said slide at a selected distance from said fixed seat.

* * * * *